US008378951B2

(12) United States Patent
Yen et al.

(10) Patent No.: US 8,378,951 B2
(45) Date of Patent: Feb. 19, 2013

(54) TIMING CONTROLLER WITH POWER-SAVING FUNCTION

(75) Inventors: Shih-Chieh Yen, Chiayi County (TW); Kuo-Lung Tsao, Kaohsiung County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 895 days.

(21) Appl. No.: 12/499,782

(22) Filed: Jul. 8, 2009

(65) Prior Publication Data

US 2010/0277463 A1 Nov. 4, 2010

(30) Foreign Application Priority Data

Apr. 29, 2009 (TW) ..... 98114208 A

(51) Int. Cl.
*G09G 3/36* (2006.01)

(52) U.S. Cl. ..... 345/99; 345/211; 348/446

(58) Field of Classification Search ..... 345/87–99, 345/211–213, 1.1, 3.2; 348/446–452
See application file for complete search history.

(56) References Cited

U.S. PATENT DOCUMENTS

| | | | | |
|---|---|---|---|---|
| 5,610,661 | A * | 3/1997 | Bhatt | 348/446 |
| 6,366,327 | B1 * | 4/2002 | Renner et al. | 348/558 |
| 7,362,295 | B2 * | 4/2008 | Park et al. | 345/89 |
| 2003/0107673 | A1 * | 6/2003 | Sato | 348/529 |
| 2004/0239802 | A1 * | 12/2004 | Kim et al. | 348/448 |
| 2006/0044251 | A1 * | 3/2006 | Kato et al. | 345/98 |
| 2006/0164362 | A1 * | 7/2006 | Ryuh | 345/96 |
| 2006/0197758 | A1 * | 9/2006 | Wang et al. | 345/213 |
| 2007/0035659 | A1 * | 2/2007 | Choi | 348/441 |
| 2007/0195028 | A1 * | 8/2007 | Katayama et al. | 345/87 |
| 2008/0291333 | A1 * | 11/2008 | Subbotin et al. | 348/700 |

* cited by examiner

*Primary Examiner* — Hong Zhou
(74) *Attorney, Agent, or Firm* — Winston Hsu; Scott Margo

(57) ABSTRACT

A time controller with power-saving function is utilized for selecting to drive a display with progressive or interlace scan method based on if two continuous frames are dynamic. The time controller comprises an interlace scan control module, a progressive scan control module, a motion detecting circuit, a scan selecting circuit, and a data selecting circuit. The interlace scan and the progressive scan control modules are utilized for generating control signals of interlace scan and progressive scan according to a video signal, respectively. The motion detecting circuit select the control signals of interlace scan or progressive scan based on if the two continuous frames are dynamic, so as to drive the display. In this way, consumed power of the display is saved and a saw-tooth effect on the video frame is avoided.

26 Claims, 9 Drawing Sheets

TIMING CONTROLLER WITH POWER-SAVING FUNCTION

BACKGROUND OF THE INVENTION

1. Field of the Invention

The present invention is related to a timing controller, and more particularly, to a timing controller utilizing interlace scan method for controlling a display device.

2. Description of the Prior Art

Please refer to FIG. 1. FIG. 1 is a diagram illustrating a conventional display panel 100. As shown in FIG. 1, the display panel 100 comprises a scan driving circuit 110, a data driving circuit 120 and a pixel area 130. According to the scan controlling signal $S_{CG}$, the scan driving circuit 110 generates the scan driving signals $S_{G1}$~$S_{GN}$ for driving the scan lines $G_1$~$G_N$, respectively. According to the data controlling signal $S_{CD}$, the data driving circuit 120 generates the data driving signals $S_{D1}$~$S_{DM}$ for driving the data lines $D_1$~$D_M$. The pixel area 130 comprises a pixel array, N scan lines, and M data lines; wherein M and N each represents a positive integer. The pixel array comprises (M columns×N rows) pixels $P_{11}$~$P_{MN}$ and every pixel is electrically connected to the corresponding scan line and the corresponding data line. In other words, pixels of $X^{th}$ row are electrically connected to the $X^{th}$ scan line and pixels of $Y^{th}$ column are electrically connected to the $Y^{th}$ data line. For instances, the pixel $P_{11}$ is electrically connected to the data line $D_1$ and the scan line $G_1$; the pixel $P_{12}$ is electrically connected to the data line $D_1$ and the scan line $G_2$; the pixel $P_{21}$ is electrically connected to the data line $D_2$ and the scan line $G_1$; the pixel $P_{22}$ is electrically connected to the data line $D_2$ and the scan line $G_2$. The pixels in the pixel area are driven by the corresponding scan driving signals for receiving the corresponding data driving signals to display the frame. For instances, upon receiving the scan receiving signal $S_{G1}$ the pixel $P_{11}$ receives the data driving signal $S_{D1}$; upon receiving the scan receiving signal $S_{G2}$ the pixel $P_{12}$ receives the data driving signal $S_{D1}$; upon receiving the scan receiving signal $S_{G1}$ the pixel $P_{21}$ receives the data driving signal $S_{D2}$; upon receiving the scan receiving signal $S_{G2}$ the pixel $P_{22}$ receives the data driving signal $S_{D2}$ . . . etc.

Please refer to FIG. 2. FIG. 2 is a diagram illustrating a conventional display device 200. The display device 200 comprises a timing controller 210 and the display panel 100. The timing controller 210 utilizes the progressive scan method to drive the display panel 100, for the display device 200 to display frames. According to the received video signal $S_{VIDEO}$, the timing controller 210 generates the scan controlling signal $S_{CG}$ and the data controlling signal $S_{CD}$ for controlling the scan driving circuit 110 and the data driving circuit 120. The timing controller 210 comprises a progressive scan controlling module 211. The video signal $S_{VIDEO}$ comprises a series of frames $F_1$, $F_2$, $F_3$ . . . etc and every frame comprises (M×N) pixel data. In other words, the video signal $S_{VIDEO}$ is a pixel data stream for sequentially transmitting every pixel data of every frame. Upon receiving the video signal $S_{VIDEO}$, the progressive scan controlling module 211 generates the progressive scan controlling signal $S_{PCG}$ and the progressive data controlling signal $S_{PCD}$. The progressive scan controlling module 211 utilizes the progressive data controlling signal $S_{PCD}$ and the progressive scan controlling signal $S_{PCG}$ as the data controlling signal $S_{CD}$ and the scan controlling signal $S_{CG}$, for outputting respectively to the scan driving circuit 110 and the data driving circuit 120. The scan driving circuit 110 and the data driving circuit 120 then generate the scan driving signals $S_{G1}$~$S_{GN}$ and the data driving signals $S_{D1\sim SDM}$ accordingly, to drive the pixel area 130 for sequentially displaying the frames $F_1$, $F_2$, $F_3$ . . . etc of the video signal $S_{VIDEO}$.

Please refer to FIG. 3. FIG. 3 is a waveform diagram illustrating the scan driving signals $S_{G1}$~$S_{GN}$ generated by the progressive scan controlling signal $S_{PCG}$ of the display device 200. Taking two consecutive frames $F_A$ and $F_{(A+1)}$ displayed by the display device 200 as an example, the duration of the frame periods $T_{FA}$ and $T_{F(A+1)}$ are identical and the frame periods $T_{FA}$ and $T_{F(A+1)}$ are equally divided into durations $T_{P11}$~$T_{P1N}$ and $T_{P21}$~$T_{P2N}$. When the display device 200 displays the frame $F_A$, within the duration $T_{P11}$, the scan driving circuit 110 generates the scan driving signal $S_{G1}$ in the scan line $G_1$ according to the scan controlling signal $S_{CG}$ and the pixels $P_{11}$~$P_{M1}$ receive the data driving signal $S_{D1\sim SDM}$ respectively; within the duration $T_{P12}$, the scan driving circuit 110 generates the scan driving signal $S_{G2}$ in the scan line $G_2$ according to the scan controlling signal $S_{CG}$ and the pixels $P_{12}$~$P_{M2}$ receive the data driving signal $S_{D1\sim SDM}$ respectively; within the duration $T_{P13}$, the scan driving circuit 110 generates the scan driving signal $S_{G3}$ in the scan line $G_3$ according to the scan controlling signal $S_{CG}$ and the pixels $P_{13}$~$P_{M3}$ receive the data driving signal $S_{D1}$~$S_{DM}$ respectively. Therefore, within the duration $T_{P1N}$, the scan driving circuit 110 generates the scan driving signal $S_{GN}$ in the scan line $G_N$ according to the scan controlling signal $S_{CG}$ and the pixels $P_{1N}$~$P_{MN}$ receive the data driving signal $S_{D1}$~$S_{DM}$ respectively. The operational principle of the display frame $F_{(A+1)}$ is similar to the display frame $F_A$ and the relative explanation is omitted hereafter. From the above-mentioned description, it is obvious that in the display device 200, the driving signals $S_{G1}$~$S_{GN}$ and $S_{D1}$~$S_{DM}$ generated from the progressive scan controlling signal $S_{PCG}$ and the progressive data controlling signal $S_{PCD}$ are able to drive the pixels corresponding to every scan line $G_1$~$G_N$ within one frame period $T_F$.

When displaying static frames (i.e. the frame $F_A$ is not much differentiated from the frame $F_{(A+1)}$), since the display device does not require to refresh the data for every pixel, consequently it is unnecessary to drive every scan line, where each scan line corresponds to a corresponding pixel. However, since the conventional display device utilizes the progressive scan method to drive the display panel, so even when displaying static frames, the pixels corresponding to every scan line are being driven, causing redundant power consumption.

SUMMARY OF THE INVENTION

The present invention discloses a timing controller with power-saving function. The timing controller comprises an interlace scan controlling module. The interlace scan controlling module comprises an odd/even determining circuit, an odd/even frame generating circuit and an interlace scan controlling circuit. The odd/even determining circuit is for calculating a number of transmitted pixel data of a video signal, to determine if a first frame transmitted from the video signal is an odd frame or an even frame, and accordingly outputting an odd/even determining signal. The odd/even frame generating circuit is for generating an odd frame signal and an even frame signal according to the first frame transmitted from the video signal; wherein the odd frame signal comprises pixel data of odd rows of the first frame, and the even frame signal comprises pixel data of even rows of the first frame. The interlace scan controlling circuit is for generating an interlace scan controlling signal and an interlace data controlling signal according to the odd/even determining signal, the odd frame signal and the even frame signal, to control a scan driving circuit and a data driving circuit respectively; wherein when the odd/even determining signal represents odd, the interlace scan controlling signal controls the scan driving circuit to generate scan driving signals in odd scan lines of the scan driving circuit, and the interlace data controlling signal controls the data driving circuit to output pixel data of odd scan lines of the first frame; wherein when the odd/even determining signal represents even, the interlace scan controlling signal controls the scan driving circuit to generate scan driving signals in even scan lines of the scan driving circuit, and the interlace data controlling signal controls the data driving circuit to output pixel data of even scan lines of the first frame.

The present invention further discloses a timing controller with power-saving function. The timing controller comprises a frame delaying circuit, an interlace scan controlling module, a progressive scan controlling module, a motion detecting circuit, a scan selecting circuit, and a data selecting circuit. The interlace scan controlling module comprises an odd/even determining circuit, an odd/even frame generating circuit, and an interlace scan controlling circuit. The odd/even determining circuit is for calculating a number of transmitted pixel data of the delayed video signal, to determine if a first frame transmitted by the delayed video signal is an odd frame or an even frame, and accordingly outputting an odd/even determining signal. The odd/even frame generating circuit is for generating an odd frame signal and an even frame signal according to the first frame transmitted from the delayed video signal; wherein the odd frame signal comprises pixel data of odd rows of the first frame, and the even frame signal comprises pixel data of even rows of the first frame. The interlace scan controlling circuit is for generating an interlace scan controlling signal and an interlace data controlling signal according to the odd/even determining signal, the odd frame signal and the even frame signal, to control a scan driving circuit and a data driving circuit respectively; wherein when the odd/even determining signal represents odd, the interlace scan controlling signal controls the scan driving circuit to generate scan driving signals in odd scan lines of the scan driving circuit, and the interlace data controlling signal controls the data driving circuit to output pixel data of odd scan lines of the first frame; wherein when the odd/even determining signal represents even, the interlace scan controlling signal controls the scan driving circuit to generate scan driving signals in even scan lines of the scan driving circuit, and the interlace data controlling signal controls the data driving circuit to output pixel data of even scan lines of the first frame. The progressive scan controlling module is for receiving the first frame of the delayed video signal and generating a progressive scan controlling signal and a progressive data controlling signal accordingly. The motion detecting circuit is for determining if between the first frame and a successive second frame of the video signal is dynamic, and outputting a motion detection signal accordingly; wherein when the motion detecting circuit determines between the first frame and the second frame is dynamic, the motion detecting circuit outputs the motion detection signal representing dynamic; wherein when the motion detecting circuit determines between the first frame and the second frame is static, the motion detecting circuit outputs the motion detection signal representing static. The scan selecting circuit is for selecting either the progressive scan controlling signal or the interlace scan controlling signal to output as a scan controlling signal according to the motion detection signal, for controlling the scan driving circuit. The data selecting circuit is for selecting either the progressive scan controlling signal or the interlace scan controlling signal to output as a data controlling signal according to the motion detection signal, for controlling the data driving circuit; wherein when the motion detection signal represents static, the scan selecting circuit and the data selecting circuit select the interlace scan controlling signal and the interlace data controlling signal respectively to output as the scan controlling signal and the data controlling signal; wherein when the motion detection signal represents dynamic, the scan selecting circuit and the data selecting circuit select the progressive scan controlling signal and the progressive data controlling signal respectively to output as the scan controlling signal and the data controlling signal.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ." Also, the term "electrically connect" is intended to mean either an indirect or direct electrical connection. Accordingly, if one device is coupled to another device, that connection may be through a direct electrical connection, or through an indirect electrical connection via other devices and connections.

Figure 1:
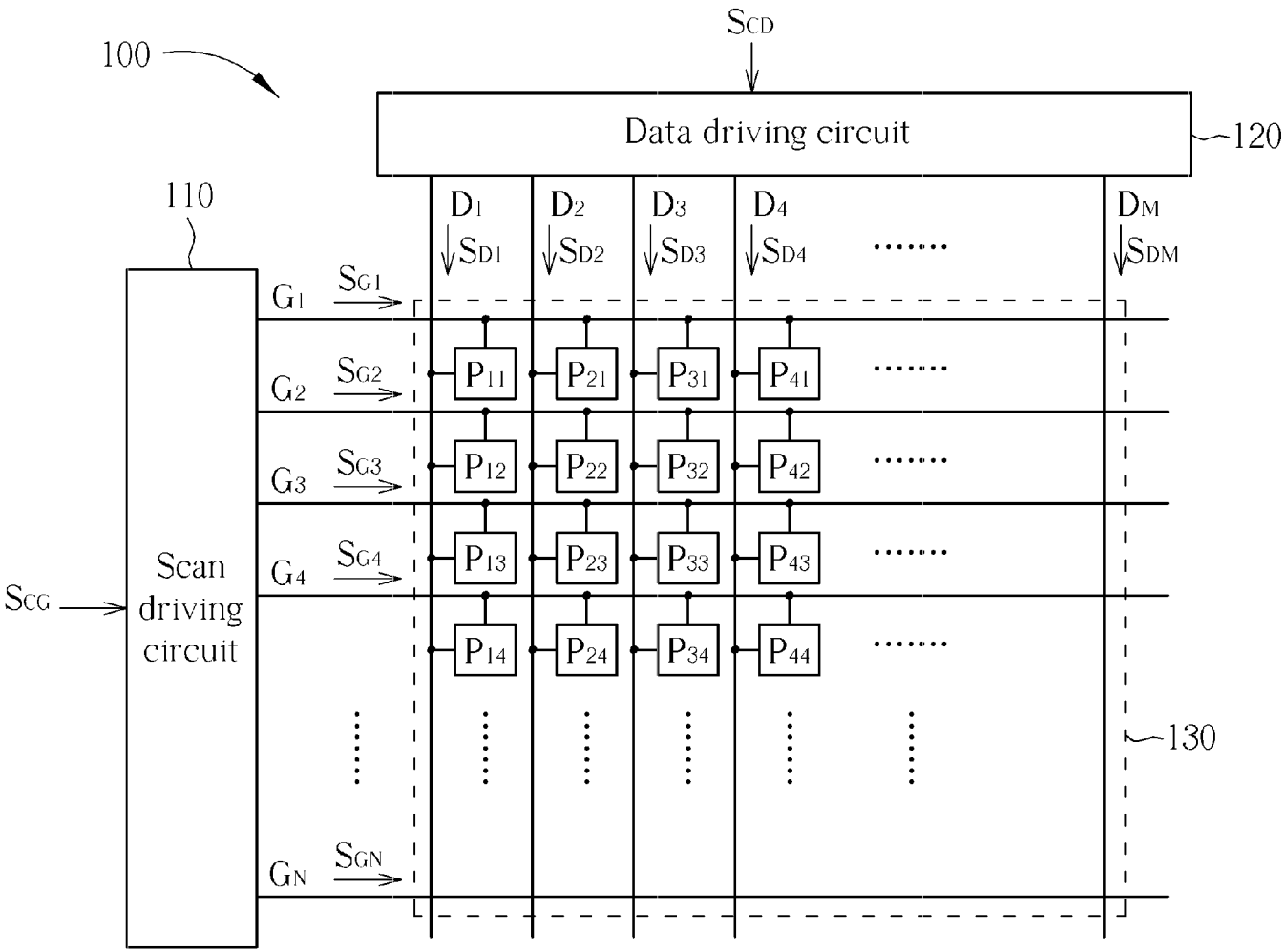
FIG. 1 PRIOR ART
FIG. 1 is a diagram illustrating a conventional display panel.
Figure 2:
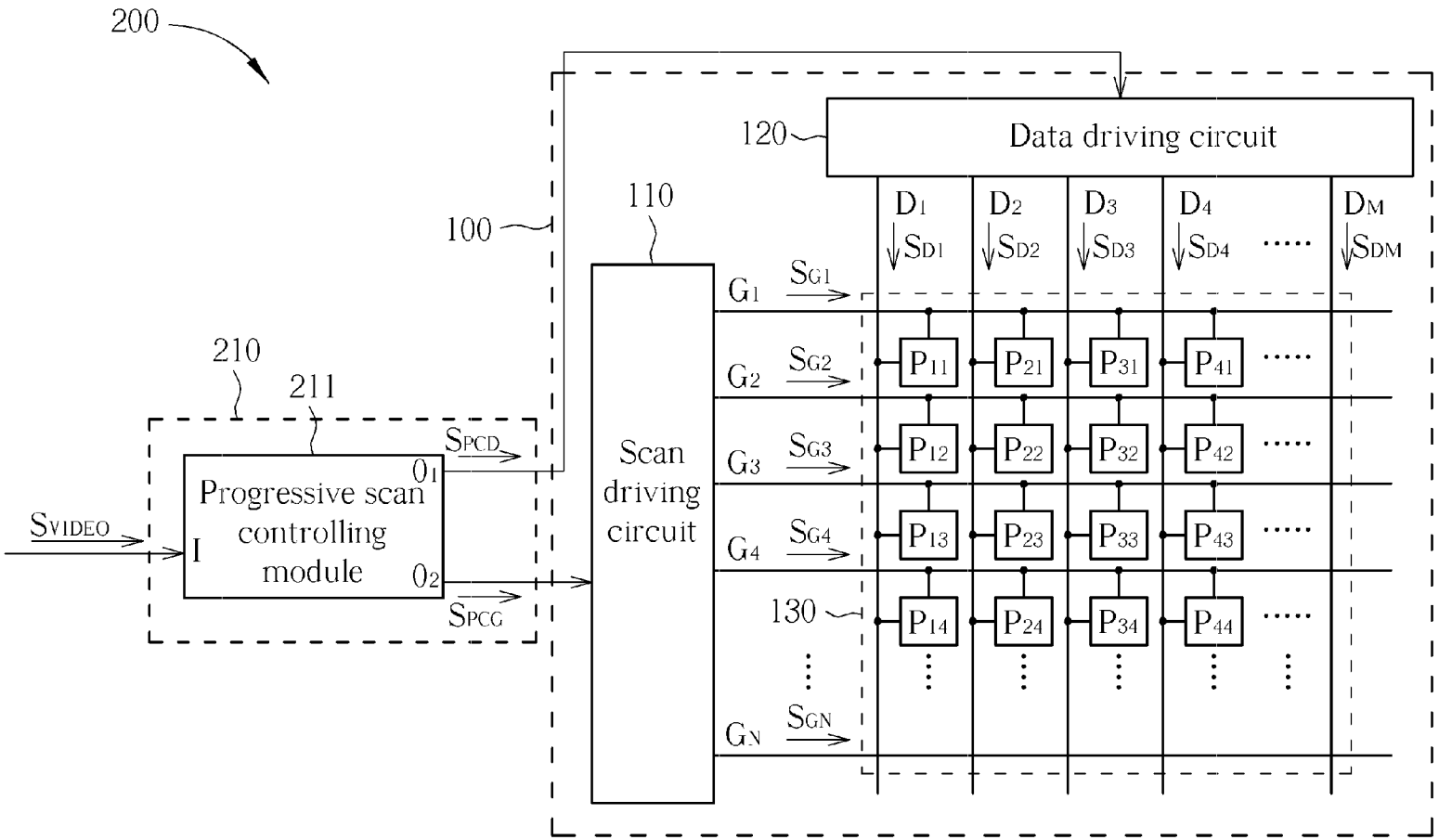
FIG. 2 PRIOR ART
FIG. 2 is a diagram illustrating a conventional display device.
Figure 3:
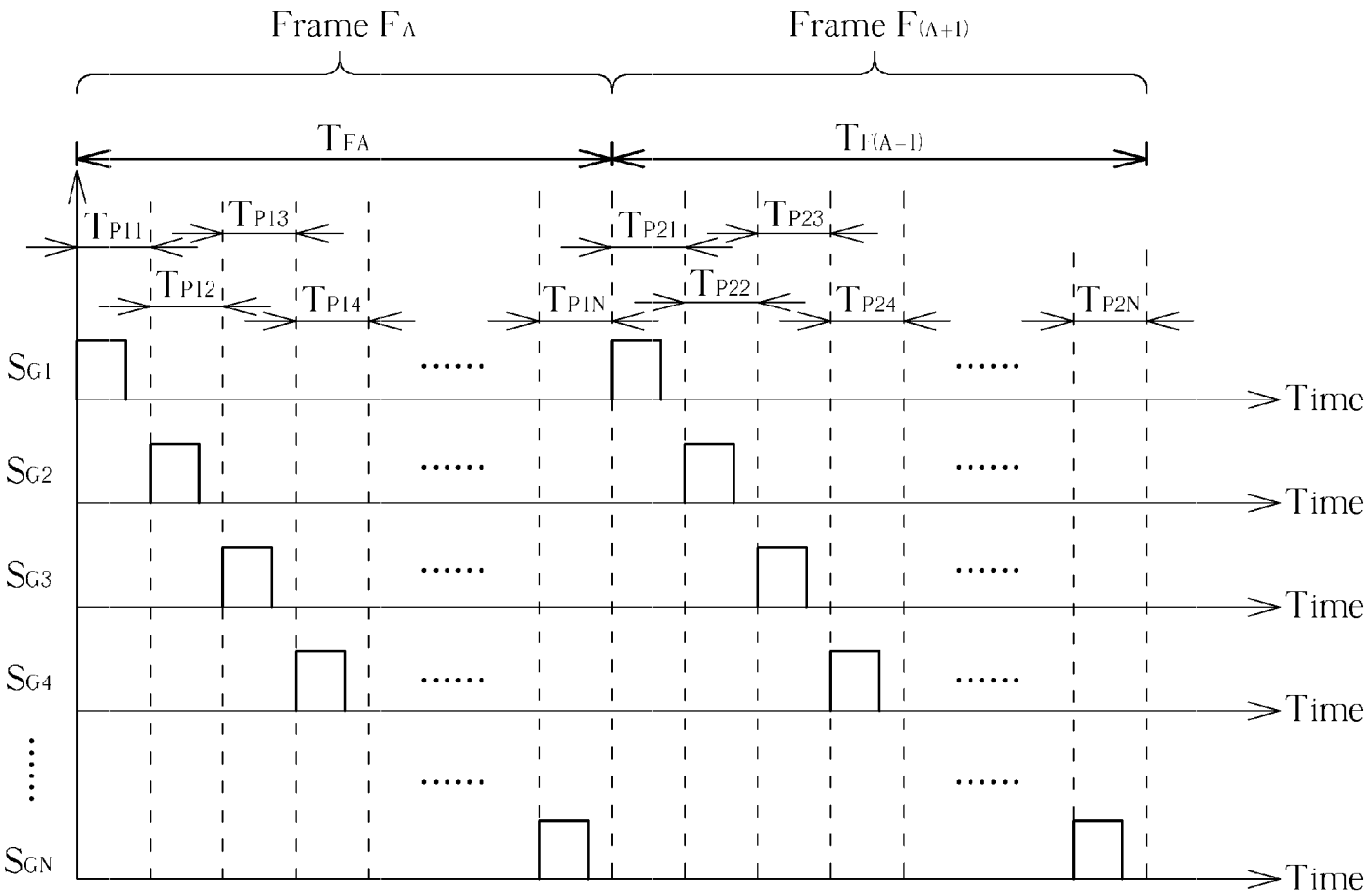
FIG. 3 is a waveform diagram illustrating the scan driving signals generated by the progressive scan controlling signal of the display device.
Figure 4:
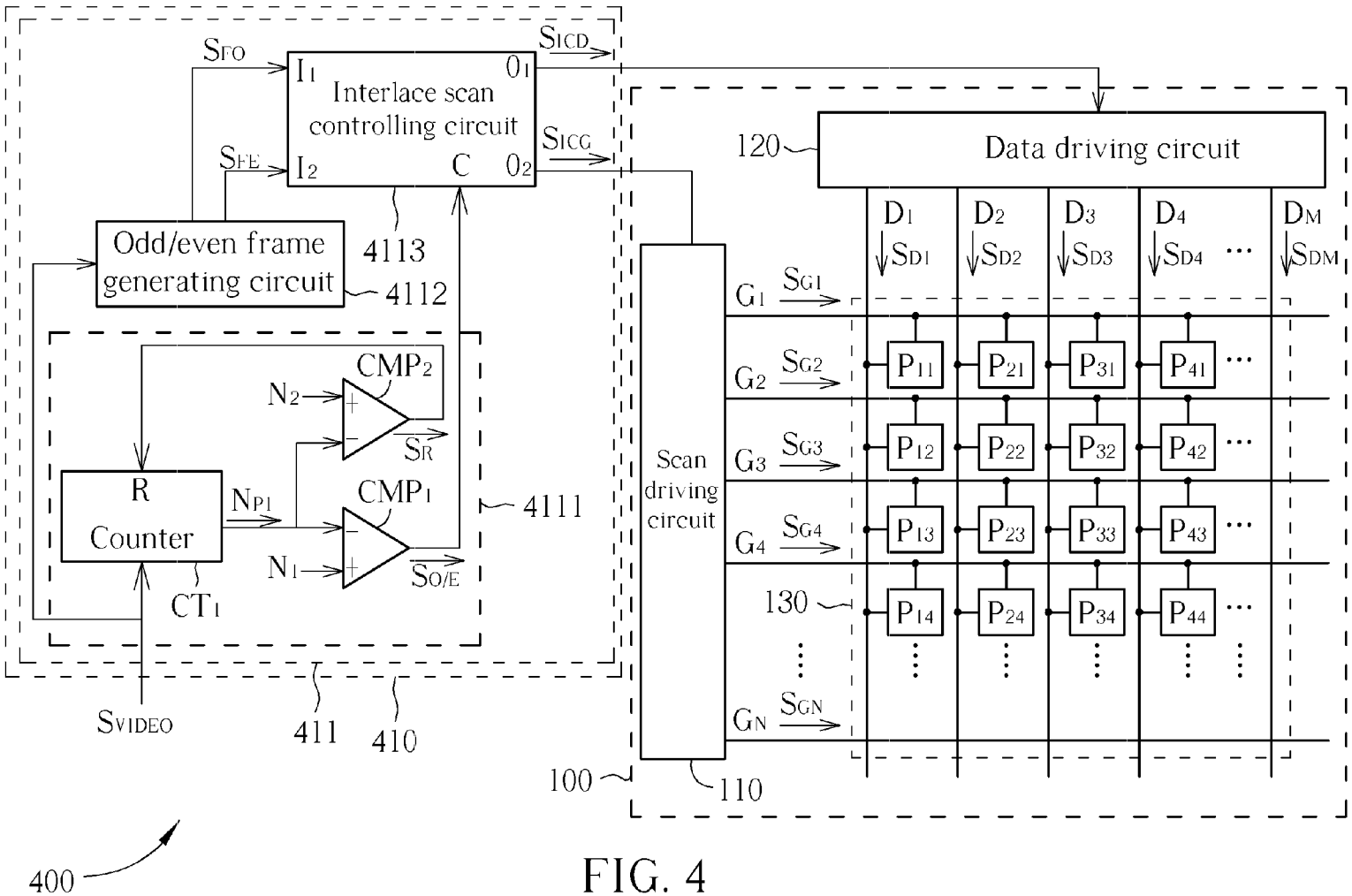
FIG. 4 is a diagram illustrating the display device according to a first embodiment of the present invention.

Please refer to FIG. 4. FIG. 4 is a diagram illustrating the display device 400 according to a first embodiment of the present invention. The display device 400 comprises a timing controller 410 with power-saving function and a display panel 100. The timing controller 410 utilizes interlace scan method to drive the display panel 100, so when the display device 400 is operating, only pixels of half the pixel area 130 are driven within every frame period and the consumed power is consequently reduced. In other words, the scan driving circuit 110 outputs the scan driving signals to only half of the scan lines for driving the corresponding pixels, so the scan driving circuit 110 does not consume redundant power to output the scan driving signals to the other half of the scan lines (i.e. the scan lines without being driven), and accordingly the corresponding pixels are not driven so more power can be saved.

The timing controller 410 comprises the interlace scan controlling module 411. The interlace scan controlling module 411 generates the interlace scan controlling signal $S_{ICG}$ and the interlace data controlling signal $S_{ICD}$ according to the video signal $S_{VIDEO}$ for controlling the scan driving circuit 110 and the data driving circuit 120. The interlace scan controlling module 411 comprises an odd/even determining circuit 4111, an odd/even frame generating circuit 4112 and an interlace scan controlling circuit 4113.

The odd/even determining circuit 4111 calculates the amount of pixel data have already been transmitted from the video signal $S_{VIDEO}$ to determine if the frame transmitted from the video signal $S_{VIDEO}$ is an odd frame or an even frame, and outputs an odd/even determining signal $S_{O/E}$ accordingly. The odd/even determining circuit 4111 comprises a counter $CT_1$ and two comparators $CMP_1$ and $CMP_2$. The counter $CT_1$ counts the number ($N_{P1}$) of the transmitted pixel data from the video signal $S_{VIDEO}$. Taking the number $N_{P1}$ of transmitted pixel data as an example, when the counter $CT_1$ receives the next pixel data via the video signal $S_{VIDEO}$, the number $N_{P1}$ of the transmitted pixel data becomes (X+1). The comparator $CMP_1$ compares the resolution value $N_1$ and the number $N_{P1}$ of transmitted pixel data for outputting the odd/even determining signal $S_{O/E}$, wherein the resolution value $N_1$ is the number of pixels (M×N) in the pixel area 130. For instances, when the number $N_{P1}$ of the transmitted pixel data is smaller than the resolution value $N_1$, the odd/even determining signal $S_{O/E}$ represents "odd"; when the number $N_{P1}$ of the transmitted pixel data equals the resolution value $N_1$, the odd/even determining signal $S_{O/E}$ represents "even". This also means that the video signal $S_{VIDEO}$ has completed transmitting the pixel data of a first frame (i.e. configured to be the odd frame) and is about to start the transmission for the pixel data of the next frame (i.e. the second frame, configured to be the even frame). The comparator $CMP_2$ compares the resolution value $N_2$ and the number $N_{P1}$ of transmitted pixels for outputting the reset signal $S_R$, wherein $N_2=2\times N_1$. When the number $N_{P1}$ of the transmitted pixel data equals the resolution value $N_2$ (i.e. when the video signal $S_{VIDEO}$ has completed transmitting two frames, such as the pixel data of the first and the second frame, to the timing controller 400), the comparator $CMP_2$ outputs the reset signal $S_R$ representing "reset" to the counter $CT_1$. When the counter $CT_1$ receives the reset signal $S_R$ representing "reset", the counter $CT_1$ resets the number $N_{P1}$ of transmitted pixel data to a predetermined value (i.e. reset to zero). Therefore, when the video signal $S_{VIDEO}$ is transmitting the odd frames (i.e. frames $F_1$, $F_3$, $F_5$ . . . etc), the odd/even determining circuit 4111 outputs the odd/even determining signal $S_{O/E}$ representing "odd"; when the video signal $S_{VIDEO}$ is transmitting the even frames (i.e. frames $F_2$, $F_4$, $F_6$ . . . etc), the odd/even determining circuit 4111 outputs the odd/even determining signal $S_{O/E}$ representing "even".

The odd/even frame generating circuit 4112 generates the odd frame signal $S_{FO}$ and the even frame signal $S_{FE}$ according to the video signal $S_{VIDEO}$, wherein each of the odd frame signal $S_{FO}$ and the even frame signal $S_{FE}$ comprises (M×N/2) pixel data. In the present embodiment, the odd frame signal $S_{FO}$ comprises the pixel data corresponding to the pixels of the odd scan lines of a display frame; the even frame signal $S_{FE}$ comprises the pixel data corresponding to the pixels of the even scan lines of the display frame. More particularly, the odd/even frame generating circuit 4112 dissects a frame $F_X$ of the video signal $S_{VIDEO}$, into an odd frame signal $S_{FO_X}$ and an even frame signal $S_{FE_X}$. The odd frame signal $S_{FO_X}$ comprises the pixel data corresponding to the pixels of the odd scan lines in the frame $F_X$, and the even frame signal $S_{FE_X}$ comprises the pixel data corresponding to the pixels of the even scan lines in the frame $F_X$.

The interlace scan controlling circuit 4113 generates the interlace scan controlling signal $S_{ICG}$ and the interlace data controlling signal $S_{ICD}$ according to the odd/even determining signal $S_{O/E}$, the odd frame signal $S_{FO}$ and the even frame signal $S_{FE}$, for controlling the scan driving circuit 110 and the data driving circuit 120. When the odd/even determining signal $S_{O/E}$ represents "odd", the interlace scan controlling circuit 4113 generates the interlace scan controlling signal $S_{ICG}$ and the interlace data controlling signal $S_{ICD}$ according to the odd frame signal $S_{FO}$, for the scan driving circuit 110 and the data driving circuit 120 to scan the pixels corresponding to the odd scan lines (e.g. scan lines $G_1$, $G_3$, $G_5$, $G_7$ . . . etc), so the pixels can receive the corresponding pixel data. More particularly, when the odd/even determining signal $S_{O/E}$ represents "odd", the interlace scan controlling circuit 4113 generates the interlace scan controlling signal $S_{ICG}$ according to the odd frame signal $S_{FO}$, for the scan driving circuit 110 to output the scan driving signals $S_{G1}$, $S_{G3}$, $S_{G5}$, $S_{G7}$ . . . etc to the corresponding scan lines $G_1$, $G_3$, $G_5$, $G_7$ . . . etc; in addition, the interlace scan controlling circuit 4113 generates the interlace data controlling signal $S_{ICD}$ according to the odd frame signal $S_{FO}$ for the data driving circuit 120 to output the data driving signals $S_{D1}$~$S_{DM}$ to the data lines $D_1$~$D_M$; as a result, the pixels of the corresponding odd scan lines can then receive the data driving signals $S_{D1}$~$S_{DM}$. When the odd/even determining signal $S_{O/E}$ represents "even", the interlace scan controlling circuit 4113 generates the interlace scan controlling signal $S_{ICG}$ according to the even frame signal $S_{FE}$, for the scan driving circuit 110 and the data driving circuit 120 to scan the pixels corresponding to the even scan lines (e.g. scan lines $G_2$, $G_4$, $G_6$, $G_8$ . . . etc), so the pixels can receive the corresponding pixel data. More particularly, when the odd/even determining signal $S_{O/E}$ represents "even", the interlace scan controlling circuit 4113 generates the interlace scan controlling signal $S_{ICG}$ according to the even frame signal $S_{FE}$, for the scan driving circuit 110 to output the scan driving signals $S_{G2}$, $S_{G4}$, $S_{G6}$, $S_{G8}$ . . . etc to the corresponding scan lines $G_2$, $G_4$, $G_6$, $G_8$ . . . etc; in addition, the interlace scan controlling circuit 4113 generates the interlace data controlling signal $S_{ICD}$ according to the even frame signal $S_{FE}$ for the data driving circuit 120 to output the data driving signals $S_{D1}$~$S_{DM}$ to the data lines $D_1$~$D_M$; as a result, the pixels of the corresponding even scan lines can then receive the data driving signals $S_{D1}$~$S_{DM}$.

As mentioned above, the timing controller 410 of the present invention can only refresh partial pixels (i.e. pixels of the corresponding odd or even scan lines) of the display panel, so less power is consumed. More particularly, when the timing controller 410 of the present invention is utilized for a display device to display a first frame of the video signal, only the pixels corresponding to the odd scan lines in the pixel area are driven to receive the pixel data corresponding to the first frame, and the frame displayed by the display device is only half of the first frame (i.e. only the portion corresponding to the odd scan lines is displayed); when the display device utilizing the timing controller 410 displays the subsequent frame (i.e. the second frame) of the first frame of the video signal, only the pixels corresponding to the even scan lines in the pixel area are driven to receive the pixel data corresponding to the second frame, and the frame displayed by the display device is only half of the second frame (i.e. only the portion corresponding to the even scan lines is displayed).

Figure 5:
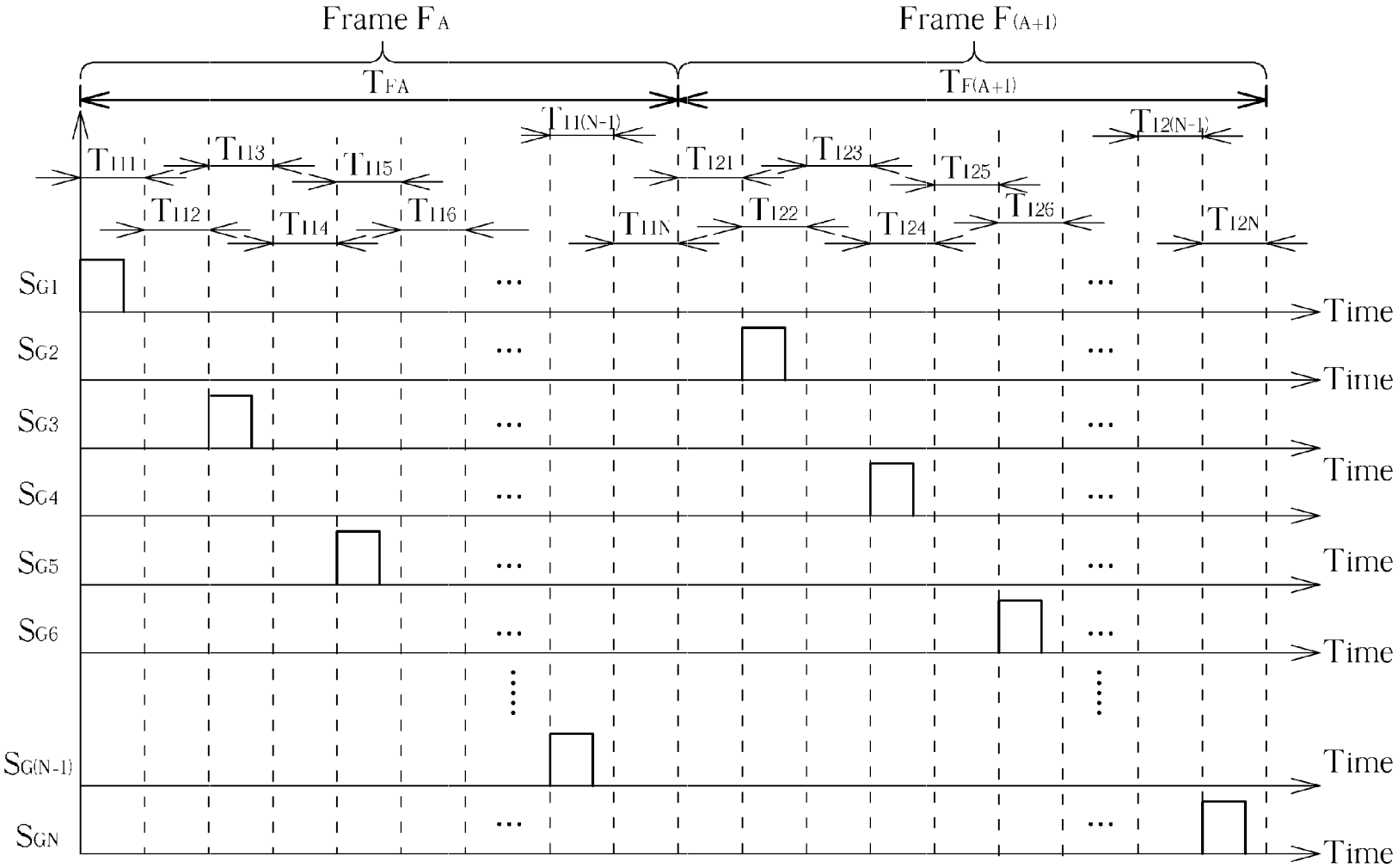
FIG. 5 is a waveform diagram illustrating the scan driving signals of the display device according to the first embodiment of the present invention.

Please refer to FIG. 5. FIG. 5 is a waveform diagram illustrating the scan driving signals $S_{G1}$~$S_{GN}$ of the display device 400 according to the first embodiment of the present invention. As shown in FIG. 5, taking the display device 400 displaying two consecutive frames $F_A$ and $F_{(A+1)}$ as an example, the duration frame periods $T_{FA}$ and $T_{F(A+1)}$ are identical and the frame periods $T_{FA}$ and $T_{F(A+1)}$ are divided into the intervals $T_{I11}$~$T_{I1N}$ and $T_{I21}$~$T_{I2N}$, respectively, wherein A represents an odd number and the intervals $T_{I11}$~$T_{I1N}$ and $T_{I21}$~$T_{I2N}$ are identical. When the display device 400 displays the frame $F_A$, the scan driving circuit 110 scans the odd scan lines $G_1$, $G_3$, $G_5$ . . . $G_{(N-1)}$ according to the interlace scan controlling signal $S_{ICG}$. More particularly, during the interval $T_{I11}$, the scan driving circuit 110 generates the scan driving signal $S_{G1}$ in the scan line $G_1$ according to the interlace scan controlling signal $S_{ICG}$, and at the same time the pixels $P_{11}$~$P_{M1}$ receive the data driving signals $S_{D1}$~$S_{DM}$ respectively; during the interval $T_{I13}$, the scan driving circuit 110 generates the scan driving signal $S_{G3}$ in the scan line $G_3$ according to the interlace scan controlling signal $S_{ICG}$, and at the same time the pixels $P_{13}$~$P_{M3}$ receive the data driving signals $S_{D1}$~$S_{DM}$ respectively; during the interval $T_{I15}$, the scan driving circuit 110 generates the scan driving signal $S_{G5}$ in the scan line $G_5$ according to the interlace scan controlling signal $S_{ICG}$, and at the same time the pixels $P_{15}$~$P_{M5}$ receive the data driving signals $S_{D1}$~$S_{DM}$ respectively. According to similar logic, during the interval $T_{I1(N-1)}$, the scan driving circuit 110 generates the scan driving signal $S_{G(N-1)}$ in the scan line $G_{(N-1)}$ according to the interlace scan controlling signal $S_{ICG}$, and at the same time the pixels $P_{1(N-1)}$~$P_{M(N-1)}$ receive the data driving signals $S_{D1}$~$S_{DM}$ respectively. When the display device displays the frame $F_{(A+1)}$, the scan driving circuit 110 scans the even scan lines $G_2$, $G_4$, $G_6$ . . . $G_N$. More specifically, during the interval $T_{I22}$, the scan driving circuit 110 generates the scan driving signal $S_{G2}$ in the scan line $G_2$ according to the interlace scan controlling signal $S_{ICG}$, and at the same time the pixels $P_{12}$~$P_{M2}$ receive the data driving signals $S_{D1}$~$S_{DM}$ respectively; during the interval $T_{I24}$, the scan driving circuit 110 generates the scan driving signal $S_{G4}$ in the scan line $G_4$ according to the interlace scan controlling signal $S_{ICG}$, and at the same time the pixels $P_{14}$~$P_{M4}$ receive the data driving signals $S_{D1}$~$S_{DM}$ respectively; during the interval $T_{I26}$, the scan driving circuit 110 generates the scan driving signal $S_{G6}$ in the scan line $G_6$ according to the interlace scan controlling signal $S_{ICG}$, and at the same time the pixels $P_{16}$~$P_{M6}$ receive the data driving signals $S_{D1}$~$S_{DM}$ respectively. According to similar logic, during the interval $T_{I2N}$, the scan driving circuit 110 generates the scan driving signal $S_{GN}$ in the scan line $G_N$ according to the interlace scan controlling signal $S_{ICG}$, and at the same time the pixels $P_{1N}$~$P_{MN}$ receive the data driving signals $S_{D1}$~$S_{DM}$ respectively. In addition, taking scanning the odd scan lines in the frame period $T_F$ and scanning the even scan lines in the subsequent frame period $T_{(F+1)}$ as an example, the scan lines $G_1$~$G_N$ can also be sorted in other schemes. For instances, the scan lines $G_1$~$G_N$ can be sorted as $G_1$, $G_2$, $G_5$, $G_6$, $G_9$, $G_{10}$ . . . and scan lines $G_3$, $G_4$, $G_7$, $G_8$, $G_{10}$, $G_{11}$ . . . etc. Therefore, as in the display device 400, the driving signals $S_{G1}$~$S_{GN}$ and $S_{D1}$~$S_{DM}$ generated from the interlace scan controlling signal $S_{ICG}$ and the interlace data controlling signal $S_{ICD}$ causes (N/2) scan lines to be scanned in every frame period $T_F$. As a result, when the display device 400 displays static frames, unnecessary power consumption can be avoided as only (N/2) scan lines are scanned in every frame period.

However, by using the interlace scanning method to refresh the display of the display device, the display device only refreshes half the pixels in the pixel area 130 in every frame period as only the odd scan lines or the even scan lines carry the scan driving signal. In other words, when the video signal $S_{VIDEO}$ is of a motion video display (i.e. the series of the frames are dynamic), the display device is likely to generate displays of discontinuous/cut frames. Therefore, the present invention provides another timing controller for saving the power of the display device and also preventing discontinuous/cut frames.

Figure 6:
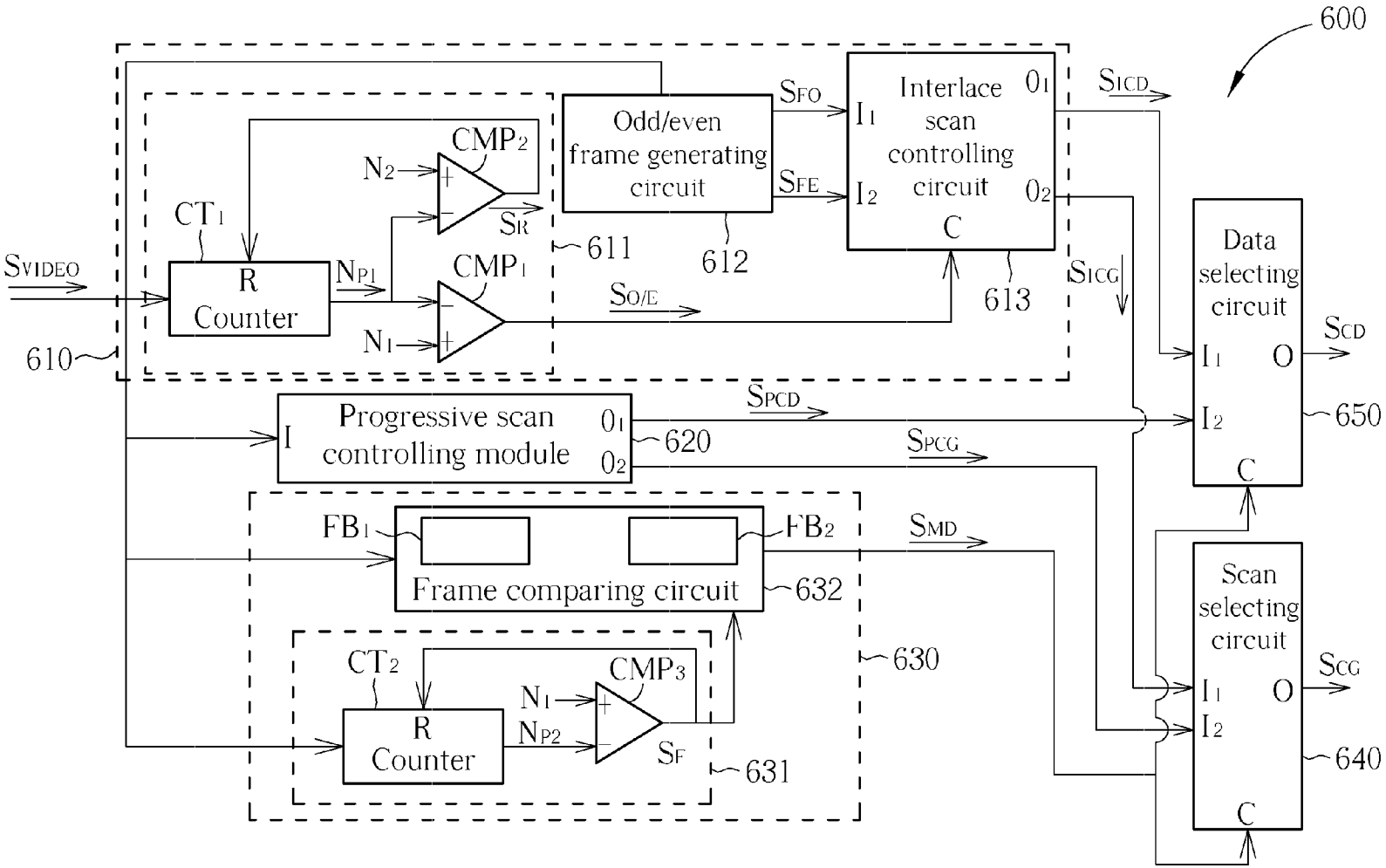
FIG. 6 is a diagram illustrating the timing controller according to the second embodiment of the present invention.

Please refer to FIG. 6. FIG. 6 is a diagram illustrating the timing controller 600 according to the second embodiment of the present invention. In the second embodiment of the present invention, the timing controller 600 selects the scanning method to be utilized by determining if the video signal $S_{VIDEO}$ is dynamic so the display device can adapt accordingly. More specifically, when the video signal $S_{VIDEO}$ the timing controller receives is static, the timing controller utilizes the interlace scanning method to drive the display panel 100 for reducing the power consumption; when the video signal $S_{VIDEO}$ the timing controller 600 receives is dynamic, the timing controller 600 utilizes the progressive scanning method to drive the display panel 100, for preventing discontinuous/cut frames.

The timing controller 600 comprises a interlace scan controlling module 610, a progressive scan controlling module 620, a motion detecting circuit 630, a scan selecting circuit 640, and a data selecting circuit 650. The structure and the operation principle of the interlace scan controlling module 610 and the progressive scan controlling module 620 are similar to those of the interlace scan controlling module 411 and the progressive scan controlling module 211; the relative description is omitted hereafter.

The motion detecting circuit 630 is utilized to determine if the video signal $S_{VIDEO}$ is dynamic and output the motion detection signal $S_{MD}$ accordingly. When the motion detecting circuit 630 determines the received video signal $S_{VIDEO}$ is dynamic, the motion detecting circuit 630 outputs the motion detection signal $S_{MD}$ representing "dynamic"; when the motion detecting circuit 630 determines the received video signal $S_{VIDEO}$ is static, the motion detecting circuit 630 outputs the motion detection signal $S_{MD}$ representing "static".

The motion detecting circuit 630 comprises a pixel counting circuit 631 and a frame comparing circuit 632.

The pixel counting circuit 631 is utilized to count the amount of pixel data transmitted from the video signal for outputting the frame triggering signal $S_F$. The pixel counting circuit 631 comprises a counter $CT_2$ and a comparator $CMP_3$. The counter $CT_2$ counts the number of transmitted pixel data ($N_{P2}$). For instances, assuming the number $N_{P2}$ is X, when the counter $CT_2$ receives a next pixel data from the video signal $S_{VIDEO}$, the number $N_{P2}$ becomes (X+1). The comparator $CMP_3$ compares the resolution value $N_1$ and the number $N_{P2}$ for accordingly outputting the frame triggering signal $S_F$. For instances, assuming the number $N_{P2}$ of the transmitted pixel data equals the resolution value $N_1$, the comparator $CMP_3$ outputs the frame triggering signal $S_F$ representing "enable/reset", which indicating the video signal $S_{VIDEO}$ has completed transmitting the pixel data of a frame. In other words, every time the video signal $S_{VIDEO}$ has completed transmitting the pixel data of a frame, the counter $CT_2$ generates a frame triggering signal $S_F$ representing "enable/reset". Also, when the counter $CT_2$ receives the frame triggering signal $S_F$ representing "enable/reset", the counter $CT_2$ resets the number $N_{P2}$ of transmitted pixel data to a predetermined value (i.e. zero).

The frame comparing circuit 632 compares the pixel data of consecutive frames (i.e. two consecutive frames $F_{(A-1)}$ and $F_A$) according to the frame triggering signal $S_F$ for outputting the motion detection signal $S_{MD}$. The frame comparing circuit 632 receives the video signal $S_{VIDEO}$, stores the pixel data of a display frame $F_{(A-1)}$ in the video signal $S_{VIDEO}$ to the frame buffer $FB_1$, as well as storing the pixel data of the display frame $F_A$ next to the display frame $F_{(A-1)}$ to the frame buffer $FB_2$. More specifically, the frame buffer $FB_1$ stores the pixel data $PD_{(A-1)11}$~$PD_{(A-1)MN}$; the frame buffer $FB_2$ stores the pixel data of the display frame $PD_{(A-1)11}$~$PD_{(A-1)MN}$. When the frame comparing circuit 632 receives the frame triggering signal $S_F$ representing "enable/reset", the frame comparing circuit 632 compares the pixel data $PD_{(A-1)11}$~$PD_{(A-1)MN}$ and $PD_{(A-1)11}$~$PD_{(A-1)MN}$ stored in the frame buffer $FB_1$ and $FB_2$ respectively, and outputs the motion detection signal $S_{MD}$ accordingly. In other words, when the frame comparing circuit 632 receives the frame triggering signal $S_F$ representing "enable/reset", which means the video signal $S_{VIDEO}$ has completed transmitting the pixel data $PD_{(A-1)11}$~$PD_{(A-1)MN}$ of the display frame $F_A$, so the frame comparing circuit 632 can then compare the display frames $F_A$ and $F_{(A-1)}$ to determine if the frame $F_{(A-1)}$ is of a motion video display (dynamic). Furthermore, the frame comparing circuit 632 compares the pixel data stored in the frame buffer $FB_1$ and $FB_2$ according to the frame differential value E between two frames. For instances, the frame buffer $FB_1$ stores the pixel data $PD_{(A-1)11}$~$PD_{(A-1)MN}$ of the frame $F_A$. The frame buffer $FB_2$ stores the pixel data $PD_{(A-1)11}$~$PD_{(A-1)MN}$ of the frame $F_{(A-1)}$. The frame differential value E between the frames $F_{(A-1)}$ and $F_A$ is obtained according to the sum of the absolute value of the differences of two corresponding pixels, as represented by the formula below:

$$E = \sum_{i=1}^{M} \sum_{j=1}^{N} |PD_{Aij} - PD_{(A-1)ij}|; \tag{1}$$

when the frame differential value E is larger than the threshold value $E_{TH}$, the frame comparing circuit 632 outputs the motion detection signal $S_{MD}$ representing "dynamic"; when the frame differential value E is smaller than the threshold value $E_{TH}$, the frame comparison circuit 632 outputs the motion detection signal $S_{MD}$ representing "static".

The motion detection signal $S_{MD}$, in fact, indicates if the frame in the previous frame period is dynamic or not (i.e. performing motion detection by comparing the frames $F_{(A-1)}$ and $F_A$ can only determines if the frame $F_A$ is dynamic). For instances, when the motion detecting circuit 630 receives the frame triggering signal $S_F$ representing "enable/reset" (i.e. this indicates a frame, such as $F_{(A+1)}$, has been completely received), the motion detecting circuit 630 determines the motion detection signal $S_{MD}$ to be "dynamic" or "static" according to the frames (i.e. frames such as $F_{(A-1)}$ and $F_A$) stored in the frame buffer $FB_1$ and $FB_2$. The motion detecting circuit 630 then outputs the motion detection signal $S_{MD}$ according to the frames $F_{(A-1)}$ and $F_A$ in the frame period $T_{F(A+1)}$.

The scan selecting circuit 640, according to the motion detection signal $S_{MD}$, selects either the progressive scan controlling signal $S_{PCG}$ or the interlace scan controlling signal $S_{ICG}$ as the scan controlling signal $S_{CG}$. The data selecting circuit 650, according to the motion detection signal $S_{MD}$, selects either the progressive data controlling signal $S_{PCD}$ or the interlace data controlling signal $S_{ICD}$ as the data controlling signal $S_{CD}$.

When the motion detection signal $S_{MD}$ represents "static", the scan selecting circuit 640 and the data selecting circuit 650 selects the interlace scan controlling signal $S_{ICG}$ and the interlace data controlling signal $S_{ICD}$ as the scan controlling signal $S_{CG}$ and the data controlling signal $S_{CD}$, respectively; when the motion detection signal $S_{MD}$ represents "dynamic", the scan selecting circuit 640 and the data selecting circuit 650 select the progressive scan controlling signal $S_{PCG}$ and the progressive data controlling signal $S_{PCD}$ as the scan controlling signal $S_{CG}$ and the data controlling signal $S_{CD}$, respectively. Therefore, when the display device displays static frames, the timing controller 600 utilizes the interlace scanning method for reducing unnecessary power consumption; when the display device displays dynamic frames, the timing controller 600 utilizes the progressive scanning method for preventing the occurrence of discontinuous/cut frames.

Figure 7:
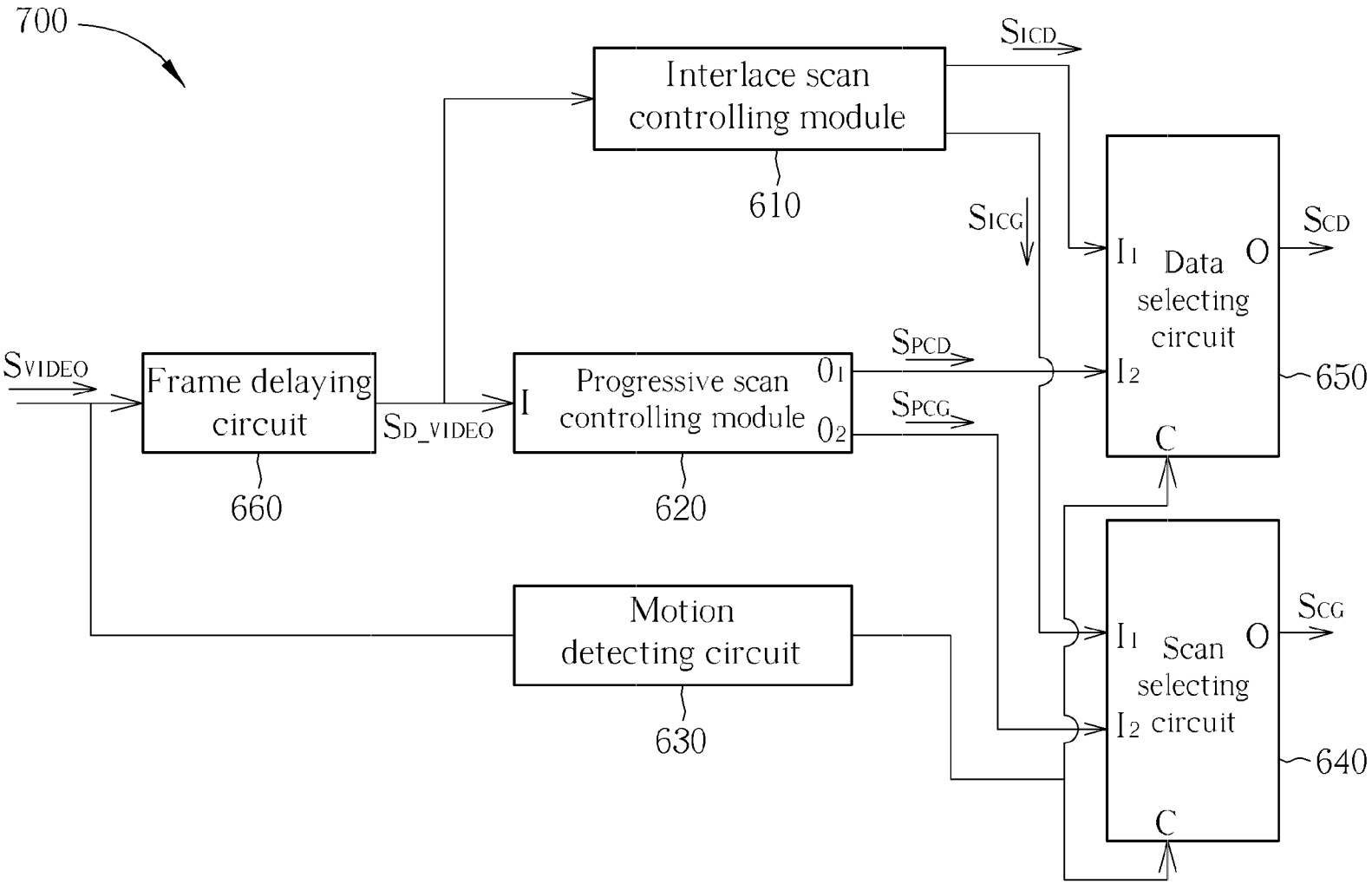
FIG. 7 is a diagram illustrating the timing controller according to the third embodiment of the present invention.

Please refer to FIG. 7. FIG. 7 is a diagram illustrating the timing controller 700 according to the third embodiment of the present invention. The structure and the operation principle of the timing controller 700 are similar to those of the timing controller 600. The timing controller 700, however, further comprises a frame delaying circuit 660. The frame delaying circuit 660 is utilized to delay the video signal $S_{VIDEO}$ a frame period $T_F$ for generating the delayed video signal $S_{D_VIDEO}$, meaning the frame delaying circuit 660 is also utilized to be a frame buffer for temporarily storing the video signal $S_{VIDEO}$. The frame delaying circuit 660 only stores the data of one frame. Therefore, when the video signal $S_{VIDEO}$ inputs a first frame to the frame delaying circuit 600, the frame delaying circuit 600 temporarily stores the first frame; when the video signal $S_{VIDEO}$ inputs the subsequent frame (i.e. the second frame) to the first frame, the frame delaying circuit 660 temporarily stores the second frame and outputs the first frame . . . and so on. Therefore, the output of the frame delaying circuit 660 is utilized as the delayed video signal $S_{D_VIDEO}$. For instances, when the frame delaying circuit 660 receives the pixel data of the frame $F_A$ via the video signal $S_{VIDEO}$, the frame delaying circuit 660 outputs the pixel data of the frame $F_{(A-1)}$ prior the frame $F_A$. Due to the fact that in the timing controller 700, the interlace scan controlling module 610 and the progressive scan controlling module 620 generate the scan controlling signals $S_{PCG}$ and $S_{ICG}$ respectively according to the delayed video signal $S_{D_VIDEO}$. In other words, the scan controlling signal $S_{CG}$ and the data controlling signal $S_{CD}$ are generated according to the delayed video signal $S_{D_VIDEO}$. Therefore, by utilizing the timing controller 700 the display device is able to delay one frame period $T_F$ when displaying display frames.

Figure 8:
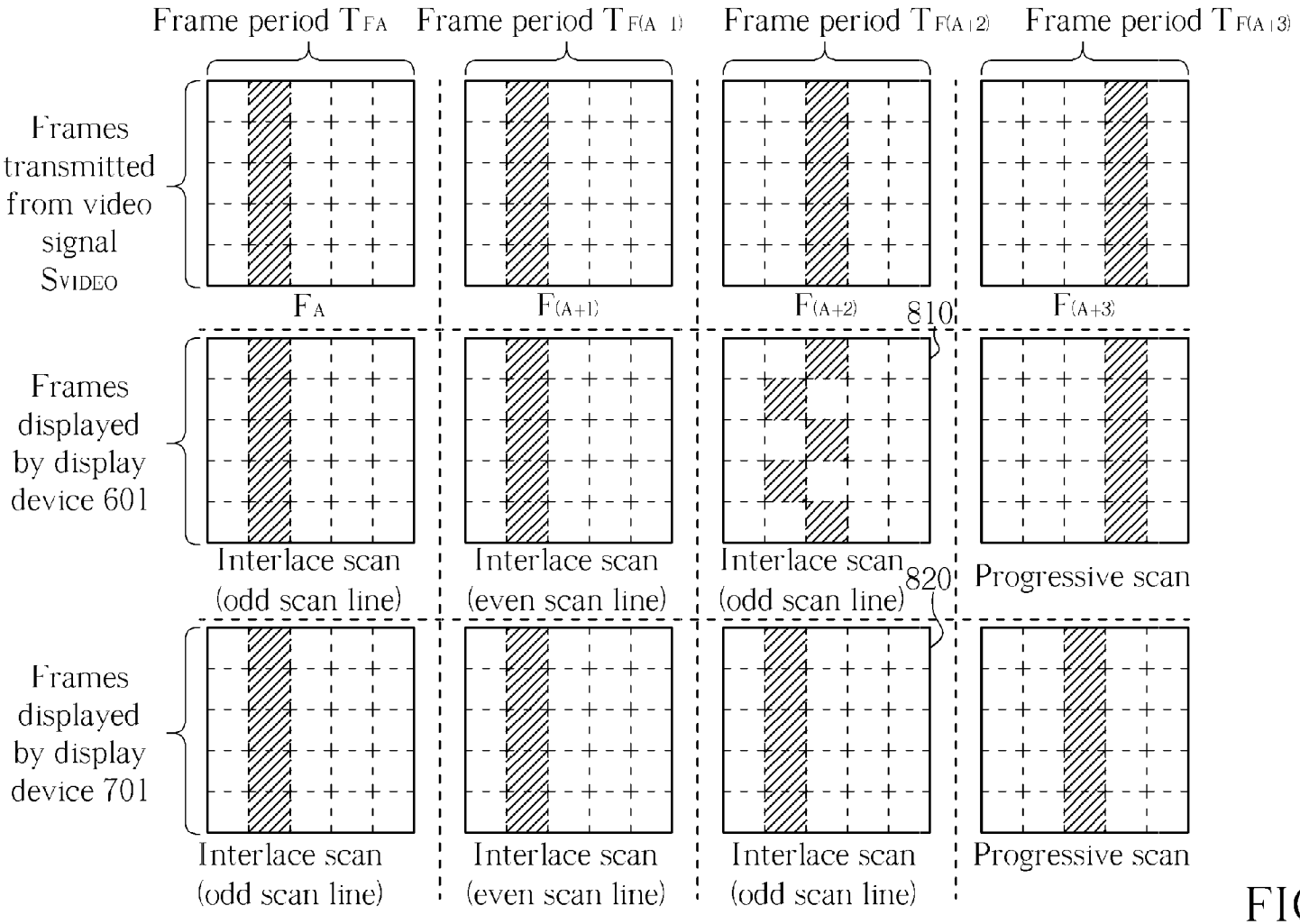
FIG. 8 is a diagram illustrating the frames displayed by the display devices from utilizing the corresponding timing controllers.

Please refer to FIG. 8. FIG. 8 is a diagram illustrating the frames displayed by the display devices 601 and 701 from utilizing the corresponding timing controllers 600 and 700. As shown in FIG. 8, due to the frame $F_{(A+1)}$ is different from the frame $F_{(A+2)}$, the frames of the display devices are determined to be dynamic starting from the frame period $T_{F(A+2)}$. However, as the motion detection signal $S_{MD}$ during the frame period $T_{F(A+2)}$ is generated from the display frames $F_{(A+1)}$ and $F_A$, the display devices 601 and 701 still utilizes the interlace scan method to drive the display panel. Consequently at the same time, the frame 810 displayed by the display device 601 has a saw-tooth effect. On the other hand, since the frame 820 displayed by the display device 701 is delayed one frame period by the frame delaying circuit 660, the frame 820 displayed by the display device 701 is generated according to the frame $F_{(A+1)}$, so the saw-tooth effect is prevented. Therefore, by utilizing the frame delaying circuit 660, the saw-tooth effect can be prevented when the display device 701 displays the frames.

Furthermore, the above-mentioned display device of the present invention can be realized by a Liquid Crystal Display (LCD), a Plasma Display or an Organic Light-Emitting Diode (OLED).

Figure 9:
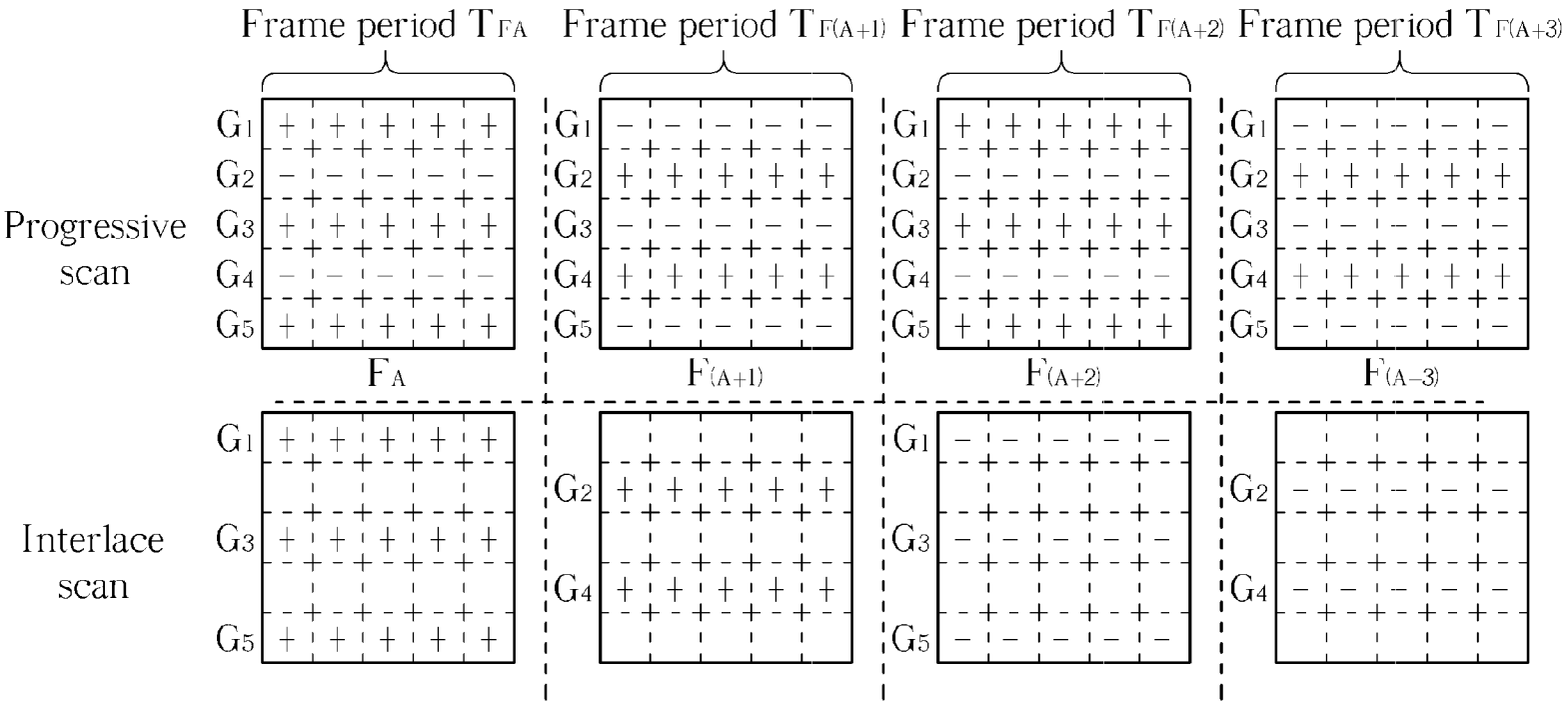
FIG. 9 is a diagram illustrating the voltage polarity of the data driving signal of the LCD of line inversion type when utilizing the progressive scan and the interlace scan methods.

Please refer to FIG. 9. FIG. 9 is a diagram illustrating the voltage polarity of the data driving signal of the LCD of line inversion type when utilizing the progressive scan and the interlace scan methods. As illustrated in FIG. 9, when the LCD of line inversion type utilizes the progressive scan method, every time a scan line completes scanning, voltage polarity of the data driving signal inverts; when the LCD of line inversion utilizes the interlace scan method, the voltage polarity of the data driving signal inverts every two frame periods. Therefore, the LCD of line inversion type saves more power by utilizing the interlace scan method instead of utilizing the progressive scan method. In other words, the LCD of line inversion type can utilize the present invention for switching to the interlace scan method when displaying static frames for reducing more power consumption.

In conclusion, the timing controller of the present invention provides the interlace scan method to drive the display panel for reducing the power consumption. Furthermore, the timing controller of the present invention is able to determine if the frame to be displayed is static or dynamic, for selecting either the progressive scan method or the interlace scan method to drive the display device, consequently power consumption can be reduced and the discontinuous/cut frames (i.e. the saw-tooth effect) can also be prevented, providing great convenience.

Those skilled in the art will readily observe that numerous modifications and alterations of the device and method may be made while retaining the teachings of the invention.

What is claimed is:

1. A timing controller with power-saving function, comprising: an interlace scan controlling module, comprising:

an odd/even determining circuit, for calculating a number of transmitted pixel data of a video signal, to determine if a first frame transmitted from the video signal is an odd frame or an even frame, and accordingly outputting an odd/even determining signal, the odd/even determining circuit comprising:

a first counter, for counting the number of the transmitted pixel data of the video signal and obtaining a first transmitted pixel value accordingly;

a first comparator, for comparing a first resolution value and the first transmitted pixel value and accordingly outputting the odd/even determining signal;

wherein the first resolution value is a number of pixels of the first frame;

wherein when the first transmitted pixel value is smaller than the first resolution value, the odd/even determining signal represents odd, and when the first transmitted pixel value is not smaller than the first resolution value, the odd/even determining signal represents even; and a second comparator, for comparing a second resolution value and the first transmitted pixel value and accordingly outputting a reset signal;

wherein the second resolution value is twice the first resolution value;

wherein when the first transmitted pixel value equals the second resolution value, the reset signal represents reset;

wherein when the first counter receives the reset signal representing reset, the first counter resets the first transmitted pixel value;

an odd/even frame generating circuit, for generating an odd frame signal and an even frame signal according to the first frame transmitted from the video signal; wherein the odd frame signal comprises pixel data of odd rows of the first frame, and the even frame signal comprises pixel data of even rows of the first frame; and an interlace scan controlling circuit, for generating an interlace scan controlling signal and an interlace data controlling signal according to the odd/even determining signal, the odd frame signal and the even frame signal, to control a scan driving circuit and a data driving circuit respectively;

wherein when the odd/even determining signal represents odd, the interlace scan controlling signal controls the scan driving circuit to generate scan driving signals in odd scan lines of the scan driving circuit, and the interlace data controlling signal controls the data driving circuit to output pixel data of odd scan lines of the first frame;

wherein when the odd/even determining signal represents even, the interlace scan controlling signal controls the scan driving circuit to generate scan driving signals in even scan lines of the scan driving circuit, and the interlace data controlling signal controls the data driving circuit to output pixel data of even scan lines of the first frame.

2. The timing controller of claim 1, wherein when the odd/even determining signal represents odd, the interlace scan controlling signal controls the scan driving circuit not to generate the scan driving signals in the even scan lines of the scan driving circuit.

3. The timing controller of claim 2, wherein when the odd/even determining signal represents even, the interlace scan controlling signal controls the scan driving circuit not to generate the scan driving signals in the odd scan lines of the scan driving circuit.

4. A display device with power-saving function, comprising:

a timing controller of claim 1; and a display panel, comprising:

a pixel area, comprising:

a pixel array, comprising a plurality of pixels arranged by M columns and N rows;

N scan lines, each scan line electrically connected to a corresponding row of pixels of the pixel array; and M data lines, each data line electrically connected to a corresponding column of pixels of the pixel array;

wherein M and N represent positive integers respectively;

a scan driving circuit, for generating corresponding scan driving signals in the N scan lines according to the interlace scan controlling signal; and a data driving circuit, for generating corresponding data driving signals in the M scan lines according to the interlace data controlling signal;

wherein a pixel of the pixel array is driven by a corresponding scan driving signal, for receiving a corresponding data driving signal.

5. The display device of claim 4, wherein the display device comprises a Liquid Crystal Display (LCD), a plasma display, or an Organic Light-Emitting Diode (OLED).

6. The display device of claim 4, wherein the display device comprises an LCD of line-inversion type.

7. A timing controller with power-saving function, comprising:

an interlace scan controlling module of claim 1;

a progressive scan controlling module, for generating a progressive scan controlling signal and a progressive data controlling signal according to the first frame of the video signal;

a motion detecting circuit, for determining if between the first frame and a successive second frame of the video signal is dynamic, and outputting a motion detection signal accordingly;

wherein when the motion detecting circuit determines between the first frame and the second frame is dynamic, the motion detecting circuit outputs the motion detection signal representing dynamic;

wherein when the motion detecting circuit determines between the first frame and the second frame is static, the motion detecting circuit outputs the motion detection signal representing static;

a scan selecting circuit, for selecting either the progressive scan controlling signal or the interlace scan controlling signal to output as a scan controlling signal according to the motion detection signal, for controlling the scan driving circuit; and a data selecting circuit, for selecting either the progressive scan controlling signal or the interlace scan controlling signal to output as a data controlling signal according to the motion detection signal, for controlling the data driving circuit;

wherein when the motion detection signal represents static, the scan selecting circuit and the data selecting circuit select the interlace scan controlling signal and the interlace data controlling signal respectively to output as the scan controlling signal and the data controlling signal;

wherein when the motion detection signal represents dynamic, the scan selecting circuit and the data selecting circuit select the progressive scan controlling signal and the progressive data controlling signal respectively to output as the scan controlling signal and the data controlling signal.

8. The timing controller of claim 7, wherein the motion detecting circuit comprises:

a pixel counting circuit, for counting a number of transmitted pixel data from the video signal to output a frame triggering signal; and a frame comparing circuit, for comparing pixel data of the first frame and the second frame according to the frame triggering signal and accordingly outputting the motion detection signal.

9. The timing controller of claim 8, wherein the pixel counting circuit comprises:

a second counter, for counting the number of the transmitted pixel data of the video signal and obtaining a second transmitted pixel value accordingly; and a third comparator, for comparing the first resolution value and the second transmitted pixel value and accordingly outputting the frame triggering signal;

wherein when the second transmitted pixel value equals the first resolution value, the third comparator outputs the frame triggering signal representing enable/reset;

wherein when the frame triggering signal represents enable/reset, the second counter resets the second transmitted pixel value.

10. The timing controller of claim 8, wherein the frame comparing circuit comprises:

a first frame buffer, for storing the first frame; and a second frame buffer, for storing the second frame;

wherein when the frame triggering signal represents enable/reset, the frame comparing circuit compares the pixel data of the first frame and the second frame for outputting the motion detection signal accordingly.

11. The timing controller of claim 10, wherein when a difference between the pixel data of the first frame and the second frame is larger than a threshold, the motion detection signal represents dynamic.

12. A display device with power-saving function, comprising:

a timing controller of claim 11; and a display panel, comprising:

a pixel area, comprising:

a pixel array, comprising a plurality of pixels arranged by M columns and N rows;

N scan lines, every scan line electrically connected to a corresponding row of pixels; and M data lines, every data line electrically connected to a corresponding column of pixels;

wherein M and N represent positive integers;

a scan driving circuit, for generating a corresponding scan driving signal in the N scan lines according to the scan controlling signal; and a data driving circuit, for generating a corresponding data driving signal in the M scan lines according to the data controlling signal;

wherein a pixel of the pixel array is driven by a corresponding scan driving signal, for receiving a corresponding data driving signal.

13. The display device of claim 12, wherein the display device comprises an LCD, a plasma display, or an OLED.

14. The display device of claim 12, wherein the display device comprises an LCD of line-inversion type.

15. A timing controller with power-saving function, comprising:

a frame delaying circuit, for delaying a video signal with a frame period, to generate a delayed video signal;

an interlace scan controlling module, comprising:

an odd/even determining circuit, for calculating a number of transmitted pixel data of the delayed video signal, to determine if a first frame transmitted by the delayed video signal is an odd frame or an even frame, and accordingly outputting an odd/even determining signal, the odd/even determining circuit comprising:

a first counter, for counting the number of the transmitted pixel data of the delayed video signal and obtaining a first transmitted pixel value accordingly;

a first comparator, for comparing a first resolution value and the first transmitted pixel value and accordingly outputting the odd/even determining signal;

wherein the first resolution value is a number of pixels of the first frame;

wherein when the first transmitted pixel value is smaller than the first resolution value, the odd/even determining signal represents odd, and when the first transmitted pixel value is not smaller than the first resolution value, the odd/even determining signal represents even; and a second comparator, for comparing a second resolution value and the first transmitted pixel value and accordingly outputting a reset signal;

wherein the second resolution value is twice the first resolution value;

wherein when the first transmitted pixel value equals the second resolution value, the reset signal represents reset;

wherein when the first counter receives the reset signal representing reset, the first counter resets the first transmitted pixel value;

an odd/even frame generating circuit, for generating an odd frame signal and an even frame signal according to the first frame transmitted from the delayed video signal;

wherein the odd frame signal comprises pixel data of odd rows of the first frame, and the even frame signal comprises pixel data of even rows of the first frame; and an interlace scan controlling circuit, for generating an interlace scan controlling signal and an interlace data controlling signal according to the odd/even determining signal, the odd frame signal and the even frame signal, to control a scan driving circuit and a data driving circuit respectively;

wherein when the odd/even determining signal represents odd, the interlace scan controlling signal controls the scan driving circuit to generate scan driving signals in odd scan lines of the scan driving circuit, and the interlace data controlling signal controls the data driving circuit to output pixel data of odd scan lines of the first frame;

wherein when the odd/even determining signal represents even, the interlace scan controlling signal controls the scan driving circuit to generate scan driving signals in even scan lines of the scan driving circuit, and the interlace data controlling signal controls the data driving circuit to output pixel data of even scan lines of the first frame;

a progressive scan controlling module, for receiving the first frame of the delayed video signal and generating a progressive scan controlling signal and a progressive data controlling signal accordingly;

a motion detecting circuit, for determining if between the first frame and a successive second frame of the video signal is dynamic, and outputting a motion detection signal accordingly;

wherein when the motion detecting circuit determines between the first frame and the second frame is dynamic, the motion detecting circuit outputs the motion detection signal representing dynamic;

wherein when the motion detecting circuit determines between the first frame and the second frame is static, the motion detecting circuit outputs the motion detection signal representing static;

a scan selecting circuit, for selecting either the progressive scan controlling signal or the interlace scan controlling signal to output as a scan controlling signal according to the motion detection signal, for controlling the scan driving circuit; and a data selecting circuit, for selecting either the progressive scan controlling signal or the interlace scan controlling signal to output as a data controlling signal according to the motion detection signal, for controlling the data driving circuit;

wherein when the motion detection signal represents static, the scan selecting circuit and the data selecting circuit select the interlace scan controlling signal and the interlace data controlling signal respectively to output as the scan controlling signal and the data controlling signal;

wherein when the motion detection signal represents dynamic, the scan selecting circuit and the data selecting circuit select the progressive scan controlling signal and the progressive data controlling signal respectively to output as the scan controlling signal and the data controlling signal.

16. The timing controller of claim 15, wherein when the odd/even determining signal represents odd and the motion detection signal represents static, the interlace scan controlling signal controls the scan driving circuit not to generate the scan driving signal in the even scan lines of the scan driving circuit.

17. The timing controller of claim 16, wherein when the odd/even determining signal represents even and the motion detection signal represents static, the interlace scan controlling signal controls the scan driving circuit not to generate the scan driving signal in the odd scan lines of the scan driving circuit.

18. The timing controller of claim 15, wherein when the video signal inputs the first frame to the frame delaying circuit, the frame delaying circuit temporarily stores the first frame; when the video signal inputs the second frame, the frame delaying circuit temporarily stores the second frame and outputs the first frame as the delayed video signal.

19. The timing controller of claim 15, wherein the motion detecting circuit comprises:

a pixel counting circuit, for counting the number of transmitted pixel data of the delayed video signal to output a frame triggering signal; and a frame comparing circuit, for comparing pixel data of the first frame and the second frame according to the frame triggering signal, to output the motion detection signal.

20. The timing controller of claim 19, wherein the pixel counting circuit comprises:

a second counter, for counting the number of transmitted pixel data of the delayed video signal and obtaining a second transmitted pixel value accordingly; and a third comparator, for comparing the first resolution value and the second transmitted pixel value and accordingly output the frame triggering signal;

wherein when the second transmitted pixel value equals the first resolution value, the third comparator outputs the frame triggering signal representing enable/reset;

wherein when the frame triggering signal represents enable/reset, the second counter resets the second transmitted pixel value.

21. The timing controller of claim 19, wherein the frame comparing circuit comprises:

a first frame buffer, for storing the first frame; and a second frame buffer, for storing the second frame;

wherein when the frame triggering signal represents enable/reset, the frame comparing circuit compares the pixel data of the first frame and the second frame for outputting the motion detection signal accordingly.

22. The timing controller of claim 21, wherein when a difference between the pixel data of the first frame and the second frame is larger than a threshold, the motion detection signal represents dynamic.

23. A display device with power-saving function, comprising:

a timing controller of claim 22; and a display panel, comprising:

a pixel area, comprising:

a pixel array, comprising a plurality of pixels arranged by M columns and N rows;

N scan lines, every scan line electrically connected to a corresponding row of pixels; and M data lines, every data line electrically connected to a corresponding column of pixels;

wherein M and N represent positive integers;

a scan driving circuit, for generating a corresponding scan driving signal in the N scan lines according to the scan controlling signal; and a data driving circuit, for generating a corresponding data driving signal in the M scan lines according to the data controlling signal;

wherein a pixel of the pixel array is driven by a corresponding scan driving signal, for receiving a corresponding data driving signal.

24. The display device of claim 23, wherein the display device comprises an LCD, a plasma display, or an OLED.

25. The display device of claim 23, wherein the display device comprises an LCD of line-inversion type.

26. A timing controller with power-saving function, comprising:

a frame delaying circuit, for delaying a video signal with a frame period, to generate a delayed video signal;

an interlace scan controlling module, comprising:

an odd/even determining circuit, for calculating a number of transmitted pixel data of the delayed video signal, to determine if a first frame transmitted by the delayed video signal is an odd frame or an even frame, and accordingly outputting an odd/even determining signal;

an odd/even frame generating circuit, for generating an odd frame signal and an even frame signal according to the first frame transmitted from the delayed video signal;

wherein the odd frame signal comprises pixel data of odd rows of the first frame, and the even frame signal comprises pixel data of even rows of the first frame; and an interlace scan controlling circuit, for generating an interlace scan controlling signal and an interlace data controlling signal according to the odd/even determining signal, the odd frame signal and the even frame signal, to control a scan driving circuit and a data driving circuit respectively;

wherein when the odd/even determining signal represents odd, the interlace scan controlling signal controls the scan driving circuit to generate scan driving signals in odd scan lines of the scan driving circuit, and the interlace data controlling signal controls the data driving circuit to output pixel data of odd scan lines of the first frame;

wherein when the odd/even determining signal represents even, the interlace scan controlling signal controls the scan driving circuit to generate scan driving signals in even scan lines of the scan driving circuit, and the interlace data controlling signal controls the data driving circuit to output pixel data of even scan lines of the first frame;

a progressive scan controlling module, for receiving the first frame of the delayed video signal and generating a progressive scan controlling signal and a progressive data controlling signal accordingly;

a motion detecting circuit, for determining if between the first frame and a successive second frame of the video signal is dynamic, and outputting a motion detection signal accordingly, the motion detecting circuit comprising:

a pixel counting circuit, for counting the number of transmitted pixel data of the delayed video signal to output a frame triggering signal; and a frame comparing circuit, for comparing pixel data of the first frame and the second frame according to the frame triggering signal, to output the motion detection signal;

wherein when the motion detecting circuit determines between the first frame and the second frame is dynamic, the motion detecting circuit outputs the motion detection signal representing dynamic;

wherein when the motion detecting circuit determines between the first frame and the second frame is static, the motion detecting circuit outputs the motion detection signal representing static;

a scan selecting circuit, for selecting either the progressive scan controlling signal or the interlace scan controlling signal to output as a scan controlling signal according to the motion detection signal, for controlling the scan driving circuit; and a data selecting circuit, for selecting either the progressive scan controlling signal or the interlace scan controlling signal to output as a data controlling signal according to the motion detection signal, for controlling the data driving circuit;

wherein when the motion detection signal represents static, the scan selecting circuit and the data selecting circuit select the interlace scan controlling signal and the interlace data controlling signal respectively to output as the scan controlling signal and the data controlling signal;

wherein when the motion detection signal represents dynamic, the scan selecting circuit and the data selecting circuit select the progressive scan controlling signal and the progressive data controlling signal respectively to output as the scan controlling signal and the data controlling signal.

* * * * *